United States Patent [19]

Hoddinott et al.

[11] Patent Number: 4,754,937

[45] Date of Patent: Jul. 5, 1988

[54] WIRE PAYOFF APPARATUS

[75] Inventors: David C. Hoddinott, Preston; Gilbert G. Grimm, Voluntown, both of Conn.

[73] Assignee: Clipper Machines, Inc., Mystic, Conn.

[21] Appl. No.: 113,666

[22] Filed: Oct. 23, 1987

[51] Int. Cl.[4] ..... B65H 49/00

[52] U.S. Cl. ..... 242/128; 242/54 R; 242/147 R; 242/155 M

[58] Field of Search ..... 242/128, 54 R, 45, 155 R, 242/155 M, 129, 129.8, 147 R, 147 M

[56] References Cited

U.S. PATENT DOCUMENTS

| | | | |
|---|---|---|---|
| 3,202,380 | 8/1965 | Hosbein | 242/128 |
| 3,806,054 | 4/1974 | Johnson et al. | 242/128 X |
| 3,997,127 | 12/1976 | Kovaleski | 242/128 |
| 4,017,037 | 4/1977 | Kovaleski | 242/128 X |
| 4,055,314 | 10/1977 | Kovaleski | 242/128 |
| 4,135,679 | 1/1979 | Murphy et al. | 242/128 |
| 4,298,174 | 11/1981 | Kovaleski | 242/128 |
| 4,687,151 | 8/1987 | Memminger et al. | 242/128 X |

*Primary Examiner*—Stanley N. Gilreath
*Attorney, Agent, or Firm*—Salter & Michaelson

[57] ABSTRACT

A wire payoff apparatus includes first and second wire spools, having first and second rotatable payoff caps thereon, respectively, first and second enclosure drums around the spools, respectively, first and second drive mechanisms for rotating the payoff caps, respectively, and a brake assembly. The apparatus further includes first and second diameter sensors for sensing the wound diameters of the spools, respectively, first and second line sensors for sensing the payoff of line from the first and second spools, respectively, a line speed sensor and a control. During operation of the apparatus, wire is alternatively payed off from the first spool or the second spool by passing over the respective payoff cap thereof as the payoff cap is rotated and the wire is passed outwardly through the respective enclosure drum to the brake assembly. The control is responsive to the diameter sensors, the line sensors and the line speed sensor for automatically adjusting the rotational speed of the payoff cap on the spool from which line is being payed off as the wound diameter of the spool is reduced. The control is further operative for automatically adjusting the amount of tension applied to the wire by the brake assembly as the wound diameter of the spool from which line is being payed off is reduced in order to maintain substantially uniform tension in wire payed off from the apparatus.

17 Claims, 4 Drawing Sheets

WIRE PAYOFF APPARATUS

BACKGROUND AND SUMMARY OF THE INVENTION

The instant invention relates to wire payoff apparatus and more particularly to an improved wire payoff apparatus of the general type wherein wire is payed off from a spool by passing it over a rotating payoff cap on a payoff end of the spool.

Wire payoff apparatus of the general type disclosed in the U.S. Pat. No. 4,135,679, to MURPHY et al, have been found to be highly effective for paying off wire from spools prior to coating or otherwise processing the wire. An apparatus of this general type normally comprises first and second spools containing quantities of wire wound thereon in predetermined wound directions, first and second payoff caps on predetermined payoff ends of the spools, and first and second payoff cap rotating mechanisms for rotating the payoff caps relative to the spools. The payoff caps of an apparatus of this type normally comprise caps of the general type disclosed in the U.S. Pat. Nos. 3,997,127; 4,017,037 and 4,055,314 to KOVALESKI; and they are operative for providing slight resistances to wire payed off from spools thereof as the wire passes over the payoff caps. In this connection, the payoff caps of an apparatus of this type are normally rotated in directions which are opposite the wound directions of the wire on the spools thereof so that the caps rotate in the same directions as the wire as it flips around the caps thereof during payoff. An apparatus of this general type further includes first and second tapered enclosure drums around the spools thereof, the enclosure drums including enlarged first ends and reduced second ends having terminal apertures therethrough. The enclosure drums of an apparatus ratus of this type are assembled over the spools thereof so that the spools can be observed through the enlarged open ends of the drums and so that wire can be payed off the spools by passing it over the payoff caps thereof as it is drawn outwardly through the apertures in the reduced ends of the drums. Further, the drums generally have elongated slots in the inwardly facing or opposed sides thereof which extend to the terminal apertures in the payoff ends thereof so that a lead wire from the inner or hub end of one spool can be connected to the wire on the other spool to enable payoff to be automatically transferred from one spool to the other spool when the wire on the original spool has been fully payed off. An apparatus of this type generally further comprises a brake assembly which alternatively receives wire from the first drum or the second drum for applying increased tension thereto as it is drawn from the apparatus.

During use of an apparatus of this type, wire is normally drawn from the brake assembly so that the wire is drawn outwardly from one of the enclosure drums and paid off from the spool therein by passing over the payoff cap on the spool. As wire is paid off from a spool in this manner, the payoff cap thereon is rotated at a speed which is just slightly less than the flip speed at which the wire passes around the payoff cap so that the payoff cap applies a slight amount of resistance to the wire as it is payed off. In this connection, however, it has been found that since the wound diameter of a spool of an apparatus of this type is inherently decreased as wire is payed off therefrom, the flip speed of the wire as it passes over the payoff cap on the spool is inherently increased during the course of the payoff as long as wire is payed off at a substantially uniform rate. Accordingly, it has been found that it is generally necessary for an operator of an apparatus of this type to closely monitor the flip speed of a wire as it is paid off from a spool by looking through the open end of the appropriate enclosure drum and to frequently adjust the speed of the payoff cap on the spool therein so that it is maintained at a level which is just slightly less than the flip speed. It has also been found that as the wound diameter of a spool of an apparatus of this type is decreased, the average angle at which wire from the spool approaches the payoff cap thereof is inherently changed so that the resistance which is applied to the wire as it passes over the cap is increased correspondingly. Accordingly, it has also been found that it is generally necessary for an operator of an apparatus of this type to closely monitor the wound diameter of the spool from which wire is being payed off and to frequently adjust the brake assembly in order to maintain the overall tension applied to a wire by the apparatus at a substantially uniform level. Unfortunately, however, it has been found that manual adjustments of this type are often neglected and that they are often imprecise when carried out. Further, it has been found that while two-spool payoff apparatus of the above described type have generally had the advantage that they enable an empty spool to be replaced while wire is being payed off from the other spool, it is not uncommon for an operator of an apparatus of this type to neglect to change an empty spool before the wire is completely payed off from both spools. When this occurs, it is generally necessary to shut down the apparatus along with any related downstream processing equipment in order to replace both spools and to feed a new wire through the apparatus and through the related downstream processing equipment. Still further, it has been found that it is not uncommon for an operator of an apparatus of this type to forget to actuate the payoff cap of a new spool before payoff is transfered to the new spool so that irregular tension is applied to the wire which can be detrimental to the operation of downstream processing equipment.

The instant invention provides an improved wire payoff apparatus which overcomes many of the disadvantages of the heretofore available payoff apparatus. The apparatus of the instant invention is preferably embodied as a two-spool payoff apparatus, although it will be understood that it can also be embodied as a single-spool payoff apparatus for paying off wire from a single spool. The preferred embodiment of the apparatus of the instant invention comprises first and second wire spools having rotatable payoff caps thereon, first and second rotating mechanisms for rotating the first and second payoff caps, respectively, and first and second enclosure drums around the first and second spools, respectively. The apparatus further comprises a brake assembly for alternatively receiving wire from the first drum as it is payed off the first spool or from the second drum as it is payed off the second spool, and the enclosure drums of the apparatus are adapted to permit payoff to be automatically transferred from the first spool to the second spool. The apparatus still further comprises first and second diameter sensors for sensing the wound diameters of the first and second spools, respectively, first and second payoff sensors for detecting the payoff of wire from the first spool and the second spool, respectively, a line speed sensor for sensing the rate of payoff from the apparatus, and a control which is responsive to the first and second diameter sensors, the first and second payoff sensors and the line speed sensor for controlling the cap speeds of the first and second payoff caps, respectively, and/or the brake assembly in order to operate the apparatus so that a substantially uniform degree of tension is applied to a wire drawn from the apparatus. The control is preferably operative for maintaining the ratio between the rotational speed of the payoff cap of the spool from which wire is being payed off and the flip speed of the wire passing over the same payoff cap at a substantially uniform level with the cap speed being slightly less than the flip speed. Further, the first control is preferably operative so that when the wound diameter of one of the spools reaches a predetermined level as wire is being payed off, the control actuates the cap rotating mechanism on the other spool if the wound diameter of the other spool exceeds a predetermined minimum value but so that it effects a controlled shut down of the spool from which wire is being payed off as well as any operatively connected down stream processing equipment if the wound diameter of the other spool is below the predetermined minimum value. Still further, the apparatus preferably comprises first and second indicating mechanisms which are responsive to the first and second diameter sensors, respectively, for indicating the amounts of wire on the first and second spools, respectively; and since visual monitoring of the spools is unnecessary, the apparatus preferably further comprises first and second end plates for substantially closing the enlarged ends of the enclosure drums in order to reduce noise emitted from the apparatus.

Accordingly, it is a primary object of the instant invention to provide an effective payoff apparatus which includes a diameter sensor for sensing the wound diameter of a payoff spool and a control which is responsive to the diameter sensor for controlling the rotational speed of a payoff cap on the spool.

Another object of the instant invention is to provide a payoff apparatus which includes a diameter sensor for sensing the wound diameter of a spool, and a control for controlling a brake assembly of the apparatus to reduce the amount of tension applied by the brake assembly to a wire drawn through the apparatus as the wound diameter of the spool is decreased.

An even further object of the instant invention is to provide an effective wire payoff apparatus which is automatically operative for applying a substantially uniform degree of tension to a wire drawn from the apparatus.

An even further object of the instant invention is to provide an effective wire payoff apparatus which is operative at a reduced sound level.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
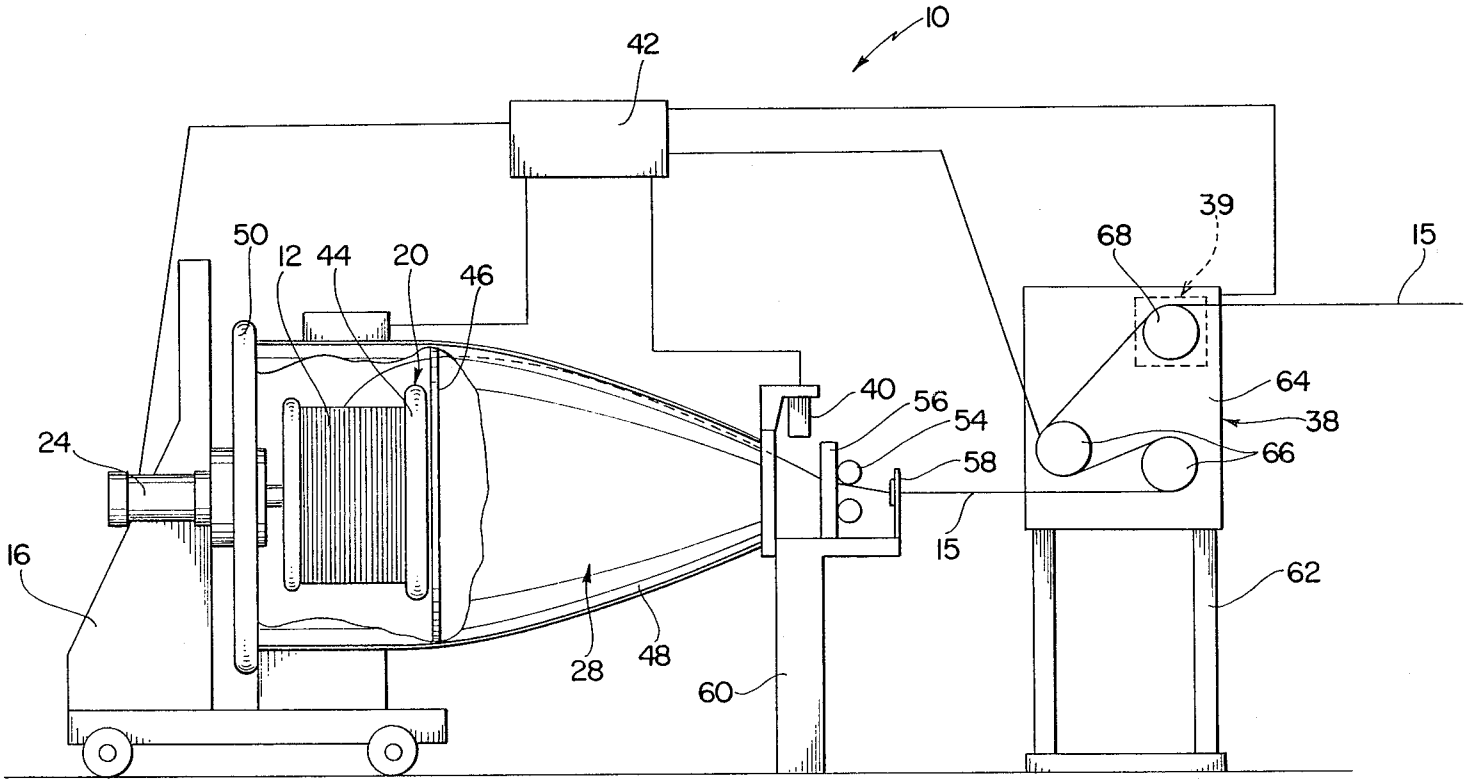
FIG. 1 is a partially schemmatic side elevational view of the apparatus of the instant invention.
Figure 2:
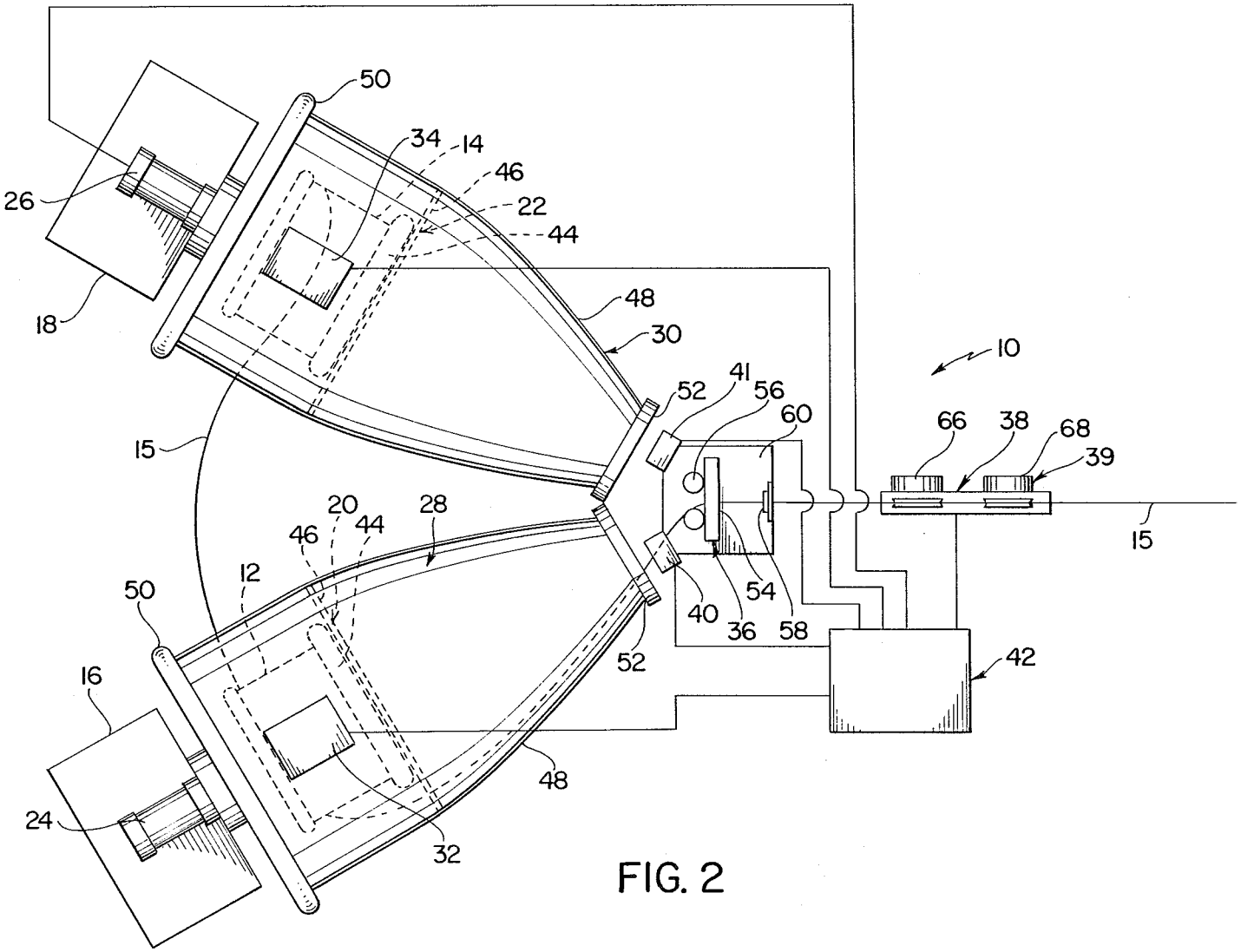
FIG. 2 is a partially schemmatic top plan view thereof.

Referring now to the drawings, the apparatus of the instant invention is illustrated and generally indicated at 10 in FIGS. 1 and 2. The apparatus 10 comprises first and second spools 12 and 14, respectively, containing quantities of wire 15 thereon, first and second mounting assemblies 16 and 18, respectively, first and second payoff caps 20 and 22, respectively, first and second drive mechanisms 24 and 26, respectively, and first and second enclosure drums 28 and 30, respectively. The apparatus 10 further comprises first and second diameter sensors 32 and 34, respectively, a guide roller assembly generally indicated at 36, a brake assembly generally indicated at 38 including a line speed sensor 39, first and second line sensors 40 and 41, respectively, and a control generally indicated at 42. The apparatus 10 is assembled so that the first and second spools 12 and 14, respectively, the first and second drive mechanisms 24 and 26, respectively, and the first and second enclosure drums 28 and 30, respectively, are supported on the first and second mounting assemblies 16 and 18, respectively, with the drums 28 and 30 positioned around the spools 12 and 14, respectively, and with the diameter sensors 32 and 34 mounted on the drums 28 and 30, respectively, so that they are operative for sensing the wound diameters of the spools 12 and 14, respectively therein. The guide assembly 26 is mounted so that it is operative for alternatively receiving wire 15 from the first spool 12 in the first enclosure drum 28 or from the second spool 14 in the second enclosure drum 30 and for feeding the wire 15 to the brake assembly 38. The line sensors 40 and 41 are mounted between the drums 28 and 30, respectively, and the guide assembly 26 for determining whether wire 15 is being payed off from the first spool 12 of the second spool 14, and the control 42 is responsive to the diameter sensors 32 and 34, the line speed sensor 39 and the line sensors 40 and 41 for controlling the drive mechanisms 24 and 26 and the brake assembly 38 so that a substantially uniform tension is applied to the wire 15 as it is payed off from the apparatus 10.

The spools 12 and 14 comprise conventional spools containing quantities of wire 15 thereon. As illustrated in FIG. 2, the spools 12 and 14 are oriented and adapted so that wire 15 can be drawn from the first spool 12 until the first spool 12 is emptied whereupon payoff is automatically transferred to the second spool 14 so that wire 15 can be payed off in a similar manner from the second spool 14. In this connection, the spools 12 and 14 are provided with lead wires which extend from the inner or barrel ends of the wire 15 thereon to the outer peripheries thereof to enable the outer end of the wire 15 on the second spool 14 to be butt welded to the lead wire from the inner or barrel end of the wire 15 on the first spool 12 so that the wires are connected as illustrated in FIG. 2. Accordingly, payoff can be automatically transferred to the second spool 14 after all of the wire 15 has been payed off from the first spool 12.

The mounting assemblies 16 and 18 comprise conventional mounting assemblies which are operative for nonrotatably mounting the spools 12 and 14 in upwardly spaced relation to a supporting surface. The mounting assemblies 12 and 14 are also operative for mounting the cap drive mechanisms 24 and 26 so that the drive mechanisms 24 and 26 communicate with the payoff caps 20 and 22, respectively, through the centers of the spools 12 and 14, respectively, as will hereinafter be more fully set fourth. The mounting assemblies 16 and 18 are further operative for supporting the enclosure drums 28 and 30 so that they are positioned around the spools 12 and 14, respectively, as illustrated in FIGS. 1 and 2.

The cap assemblies 20 and 22 are also of conventional construction and they preferably comprise cap assemblies of the general type disclosed in the U.S. Pat. Nos. 3,972,489, 3,997,127, and 4,017,307 to KOVALESKI. The cap assemblies 20 preferably include caps 44 which are rotatably received on the payoff ends of the spools 12 and 14 and radially extending brushes 46 which extend outwardly from the caps 44 beyond the peripheries thereof. The cap assemblies 20 and 22 are operative for applying controlled resistance to the wire 15 as it is payed off from the spools 12 and 14. Specifically, the cap assemblies 20 and 22 are constructed so that the wire 15 passes through the brushes 46 of the cap 20 or 22 on the spool 12 or 14 from which wire 15 is being payed off in order to provide controlled resistance to the wire 15 in a manner well known in the art.

The cap assembly drive mechanisms 24 and 26 are also of generally conventional construction, and they are operative for rotating the cap assemblies 20 and 22, respectively, relative to the spools 12 and 14. The drive assemblies 24 and 26 are mounted on the stands 16 and 18, respectively, and they communicate with the cap assemblies 20 and 22, respectively, through the centers of the spools 12 and 14, respectively, for rotating the cap assemblies 20 and 22, respectively, relative to the spools 12 and 14, respectively. The drive mechanisms 24 and 26 preferably comprise electrically energized motors including motor controls which are electronically adjustable for controlling the rotational speeds of the cap assemblies 20 and 22, respectively.

The enclosure drums 28 and 30 preferably include main housing sections 48 and end plates 50. The main housing sections 48 are preferably of conventional construction, and they preferably comprise housings of the general type disclosed in the U.S. Pat. Nos. 3,131,884, to DUFF and WEBBER, 4,148,448. The housing sections 48 are preferably of generally open conical configuration and they include reduced payoff ends 52 having apertures (not shown) therethrough for drawing wire 15 outwardly from the enclosure drums 28 and 30. The housing sections 48 are further formed with elongated slots (not shown) which extend along the inwardly facing sides thereof to the apertures in the payoff ends 52 thereof to enable the wire 15 on the first spool 12 to be connected to the wire 15 on the second spool 14 so that payoff can be automatically transferred from the first spool 12 to the second spool 14 as hereinabove set forth. The enclosure drums 28 and 30 are mounted on the mounting assemblies 16 and 18, respectively. to position them around the spools 12 and 14, respectively, as illustrated. The end plates 50 are preferably secured to the main housing sections 48 for substantially enclosing the ends of the enclosure drums 28 and 30 in order to reduce the level of the noise emitted from the apparatus 10. The end plates 50 are, however, formed with openings therethrough for enabling the drive mechanisms 24 and 26 to communicate with the payoff caps 20 and 22, respectively, and for enabling the spools 12 and 14 to be supported on the mounting assemblies 16 and 18, respectively, inside of the enclosure drums 28 and 30, respectively.

The diameter sensors 32 and 34 preferably comprise conventional ultrasonic sensors which are operative for sensing the wound diameters of the spools 12 and 14, respectively, over predetermined ranges. The sensors 32 and 34 are preferably operative for producing signals over ranges of between 4 and 20 mA which correspond to the wound diameters of the spools 12 and 14 over ranges defined by the fully unwound and fully wound diameters thereof. It will be understood, however, that while the sensors 32 and 34 preferably comprise ultrasonic sensors, other embodiments of the apparatus of the instant invention which include other types of diameter sensors are contemplated.

The guide roller assembly 36 is of conventional construction, and it comprises a pair of substantially horizontal rollers 54, a pair of substantially vertical rollers 56, and an aperture plate 58. The rollers 54 and 56 and the aperture plate 58 are mounted on a stand 60, and they are positioned to enable the guide roller assembly 36 to alternatively receive wire 15 from the first enclosure drum 28 or from the second enclosure drum 30 with the wire 15 first passing between the rollers 56, then between the rollers 54 and finally through the plate 58. The guide roller assembly 36 is further positioned for guiding the wire 15 so that it passes to the brake assembly 38 after it passes through the plate 58.

The brake assembly 38 is operative for adjustably applying tension to the wire 15 as it is drawn through the apparatus 10. The brake assembly 38 comprises a mounting stand 62 on which a main mounting plate 64 is supported and a pair of brake pulleys 66 and an idler pulley 68 which are mounted on the main mounting plate 64. The brake pulleys 66 are operative for applying tension to the wire 15 as it is drawn through the apparatus. The idler pulley 68 comprises part of the line speed sensor 39 which is operative for producing a signal having a voltage level which is proportional to the speed of the wire 15 as it is drawn through the apparatus 10. In this regard, the line speed sensor 39 includes a digital encoder (not shown) which is operative for producing pulses at a frequency which is proportional to the rotational speed of the idler pulley 68 and a frequency-to-voltage converter (not shown) which is operative for converting the pulse signal from the encoder to a signal having a voltage level which is proportional to line speed. The brake assembly 38 further includes a conventional DC control which is electronically adjustable for adjusting the tension which is applied to the wire 15 by the brake pulleys 66.

The line sensors 40 and 41 preferably comprise capacitive proximity sensors and they are operative for determining whether the wire 15 is being payed off from the first spool 12 or from the second spool 14. The sensors 40 and 41 are preferably mounted on the stand 60, and they are positioned adjacent the payoff ends 52 of the enclosure drums 28 and 30, respectively.

The control 42 is responsive to the diameter sensors 32 and 34, the line speed sensor 39, and the line sensors 40 and 41 for controlling both the cap drive mechanisms 24 and 26 and the brake assembly 38 in order to maintain a substantially uniform tension level in the wire 15 as it is drawn from the apparatus 10. More specifically, the control 42 is responsive to the line sensors 40 and 41 for determining whether wire 15 is being payed off from the first spool 12 or the second spool 14, and it is responsive to the line speed sensor 39 and diameter sensor 32 or 34 of the active spool 12 or 14 from which wire is being payed off for controlling the respective drive mechanism 24 or 26 thereof in order to maintain the speed of the respective cap 20 or 22 thereof at a rate which is slightly less than the flip speed at which the wire 15 is travelling around the cap 20 or 22. In this regard, since the flip speed of the wire 15 passing over the active cap 20 or 22 is inherently increased as the wound diameter of the cap 20 or 22 is decreased, the control 42 is operative for increasing the rotational speed of the active cap 20 or 22 as the wound diameter of the respective spool 12 or 14 thereof is decreased. It is also operative for changing the speed of the operative cap 20 or 22 to compensate for changes in line speed. The control 42 is further operative for reducing the tension applied to the wire 15 by the brake assembly 38 as the wound diameter of the spool 12 or 14 from which the wire 15 is being payed off is decreased. In this connection, since a wire 15 on the active spool 12 or 14 must inherently approach the cap 20 or 22 thereof at a changed angle as the wound diameter of the active spool 12 or 14 is decreased, the resistance applied by the active cap 20 or 22 to the wire 15 is inherently increased as the wound diameter of the active spool 12 or 14 is decreased. The control 42 is operative for compensating for this change in resistance applied to the wire 15 by the cap 20 or 22 by proportionally reducing the resistance applied to the wire 15 by the brake assembly 38 as the wound diameter of the active spool 12 or 14 is reduced.

Figure 3:
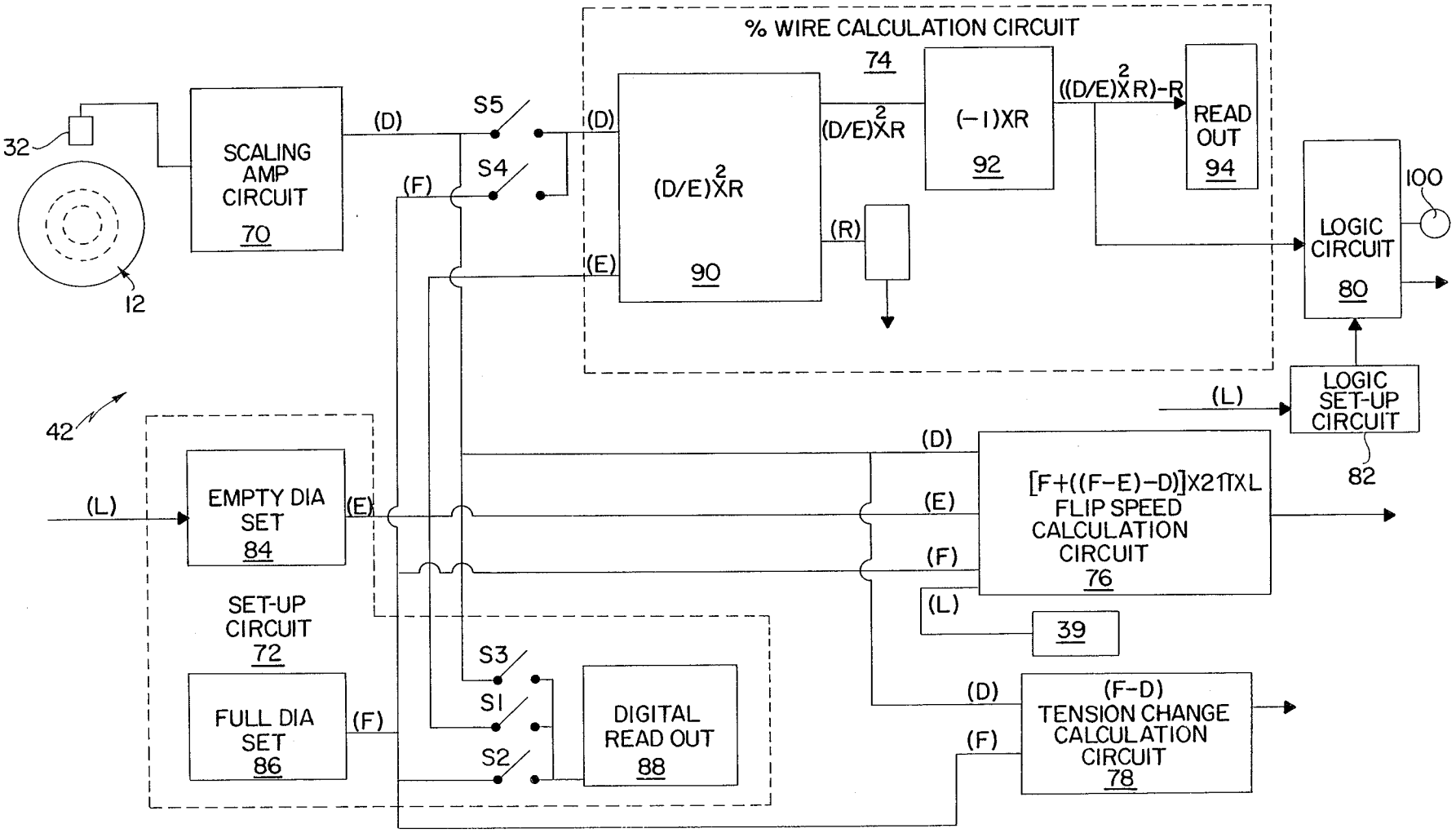
FIG. 3 is a block diagram of the first section of the control.

The control 42 comprises two basic sections, a first section which is responsive to the line speed sensor 39, the first diameter sensor 32 and the first line sensor 40, and a second section which is responsive to the line speed sensor 39, the second diameter sensor 34 and second line sensor 41. In this connection, the two sections of the control 42 are essentially identical with a few minor exceptions as noted herein; and, therefore, only the first section of the control 42 is described in detail herein. Referring to FIG. 3, the first section of the control 42 which is responsive to the line speed sensor 39, first diameter sensor 32 and the first line sensor 40 is illustrated. The first control section comprises a scaling amp circuit 70, a setup circuit 72, a percent wire calculation circuit 74, a flip speed calculation circuit 76, a tension change calculation circuit 78, a logic circuit 80 and a logic setup circuit 82.

The scaling amp circuit 70 comprises a conventional scaling amplifier circuit which is operative for converting the 4–20 mA signal from the sensor 32 to a 0–10 volt signal D.

The setup circuit 72 comprises an empty diameter set point circuit 84, a full diameter set point circuit 86, and a digital readout 88. The empty diameter set point circuit 84 and the full diameter set point circuit 86 comprise conventional adjustable input circuits, and they include potentiometers and buffered amplifiers which are operative for producing constant voltage signals of E and F, respectively, corresponding to the set point settings on the respective potentiometers thereof. The digital readout 88 preferably comprises a conventional LCD digital readout such as a DMLX 3-1 readout device of the type manufactured by Datel, Inc. The digital readout circuit 86 is connectable to the empty diameter set point circuit 84 and the full diameter set point circuit 86 through switches $S_1$ and $S_2$, and the digital readout circuit 88 is connectable to the scaling amplifier circuit 70 through a switch $S_3$. The digital readout circuit 88 is connectable to the percent wire calculation circuit 74 through the switch $S_2$ and a switch $S_4$, and the scaling amplifier circuit 70 is connectable to the percent wire calculation circuit 74 through a switch $S_5$. Accordingly, the empty diameter set point, the full diameter set point and the actual wound diameter of the spool 12 can be monitored utilizing the digital readout 88.

The percent wire calculation circuit 74 comprises a conventional analog computation circuit 90 which preferably comprises a conventional analog computation circuit chip of the type manufactured by Analog Devices Inc. as an AD 538 chip. The analog computation circuit 90 is set up to provide a scaling equal to a predetermined constant R and it is connected in accordance with conventional setup techniques to perform a mathematical function of $(D/E)^2 \times R$. The percent wire calculation circuit 74 further comprises a subtracting amp circuit 92 preferably comprising an operational amplifier, such as an LM 308, which is connected to perform a mathematical function of subtracting R from the product of the analog computation circuit 90 so that the wire calculation circuit 74 produces a zero value when the wire 15 is fully unwound from the spool 12. The wire calculation circuit 74 further comprises a conventional digital readout 94 which is connected to the subtracting amp circuit 92 for indicating the percentage of the wire 15 remaining on the spool 12. The output from the subtracting amp circuit 92 is further connected to the logic circuit 80 for supplying a wire percentage value thereto.

The flip speed calculation circuit 76 includes a plurality of summing amplifiers, such as LM 308 operational amplifiers, and an analog computation circuit, such as an AD 538. The flip speed calculation circuit 76 receives the D, E and F signals from the scaling amp circuit 70, the empty diameter set point circuit 84 and the full diameter set point circuit 86 and it receives an L signal representing the wire line speed from the line speed sensor 69. The flip speed calculation circuit 76 is operative for performing a mathematical function of $[F+((F-E)-D)] \times 2\pi L$. The resultant voltage level produced by the circuit 76 corresponds to the theoretical flip speed of the wire 15 as it is payed off from the spool 12, and it is fed to the motor control of the drive mechanism 24 for controlling the rotational speed of the cap 20 as the wound diameter of the spool 12 is decreased and/or as the line speed is changed. In this connection, the motor control of the drive mechanism 24 is preferably adjusted to maintain the rotational speed of the cap 20 at a level which is slightly less than the corresponding flip speed by a predetermined proportional amount.

The tension change calculation circuit 78 comprises a conventional summing amplifier, such as an LM 308 operational amplifier, and it is operative for producing a sum representing $(F-D)$. The resultant value produced by the tension change calculation circuit 78 is fed to the brake assembly 38 for proportionally reducing the amount of tension applied to the wire 15 by the brake assembly 38 as the wound diameter of the wire 15 on the spool 12 is decreased.

Figure 4:
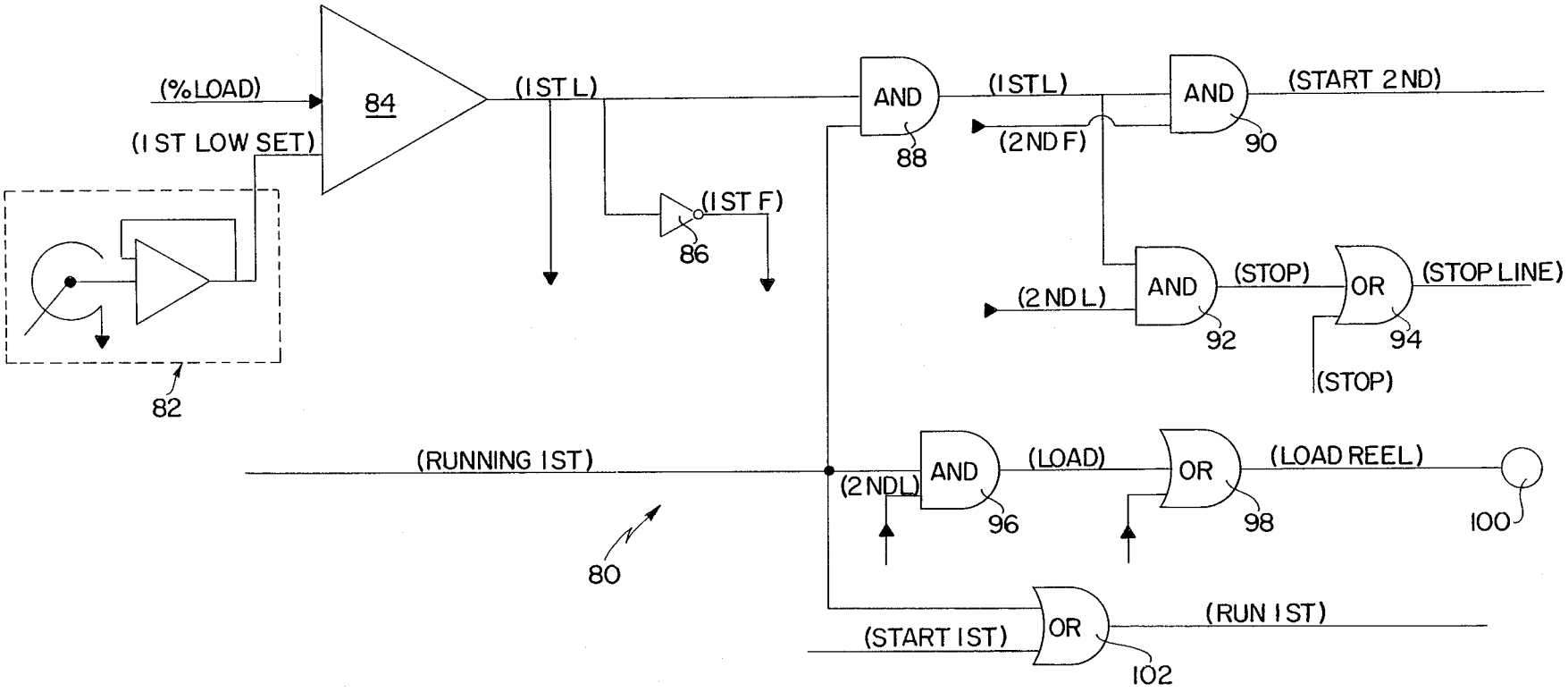
FIG. 4 is a schemmatic diagram of the logic circuit of the first section of the control.

The logic circuit 80 and the logic set up circuit 82 are more clearly illustrated in FIG. 4. The logic set up circuit 82 comprises a potentiometer, a buffered amplifier, and a summing amplifier; and it is operative for providing a value representing the sum of an adjustable set point plus the line speed. This value is fed to the logic circuit 80 to provide an alarm level at which the logic circuit 80 either actuates the second cap drive mechanism 26 or effects a controlled shutdown of the first cap drive mechanism 24 and any related processing equipment operatively connected to the control 42.

The logic circuit 80 comprises a series of AND gates and OR gates which are interconnected in accordance with known techniques to perform a series of predetermined logic functions. In this regard, the logic circuit 80 is responsive to both the percentage value produced by the wire calculation circuit 74 and the set point signal from the logic setup circuit 82 for actuating the second cap drive mechanism 26 when the percentage of wire remaining on the spool 12 falls below the set point level and the percentage of wire remaining on the second spool 14 exceeds its corresponding set point level in the second control section. The logic circuit 80 is also operative for effecting a controlled shutdown of the first cap drive mechanism 24 as well as any operatively connected downstream processing equipment when the percent value produced by the wire calculation circuit falls below the set point level and the amount of wire on the second spool 14 is below its corresponding set point level. Accordingly, the circuit 80 is operative for actuating the drive mechanism 26 to effect rotation of the second cap 22 before payoff is transferred to the second spool 14, as long as the second spool 14 is full or at least not below its set point level, and it is also operative for deactuating the first cap 20 after payoff has been transferred to the second spool 14. The logic circuit 80 is also operative for deactuating the first drive mechanism 24 and any related down stream processing equipment operatively connected to the control 42 if the percentage of the wire 15 remaining spool 12 falls below its set point level and the second spool is empty; and, hence, it is operative for shutting down the apparatus 10 along with any operatively connected equipment before all of the wire has been payed off from the first spool 12.

The logic circuit 80 comprises a comparator 84 which is operative for comparing the voltage level of the signal from the percent calculation circuit 74 with the voltage level of the signal from the logic set up circuit 82 and for producing a high level output signal when the voltage level of the signal from the percent wire calculation circuit 72 falls below the set point voltage level from the setup circuit 82. The output from the comparator 84 is designated as a 1st L signal (first spool 12 low), and it is fed to the second section of the control 42 which is responsive to the second diameter sensor 34 and the second line sensor 41. The 1st L signal is also inverted through an inverter 86 to provide a 1st F signal (first spool 12 not low) which is also fed to the second section of the control 42. The 1st L signal is also fed to an AND gate 88 and a Running 1st signal (running first spool 12) from the first line sensor 40 is also fed to the AND gate 88. In the event that the Running 1st signal and the 1st L signal are both at high levels indicating that wire is being unwound from the first spool 12 and that the amount of wire 15 on the first spool 12 is below the set point level, a high level 1st L signal from the AND gate 88 is fed to a second AND gate 90. The second AND gate 90 is connected to the second section of the control 42 which is responsive to the sensors 34 and 41 for receiving a 2nd F signal (second spool 14 not low). The 2nd F signal has a high level when the second spool 14 is full; and when both the 2nd F signal and the 1st L signal from the AND gate 88 are at high levels, the AND gate 90 emits a high level Start 2nd signal (start second cap 22). The Start 2nd signal from the AND gate 90 is fed to the second section of the control 42 for actuating the second drive mechanism 26 to commence rotation of the second cap 22. The signal from the AND gate 88 is also fed to an AND gate 92, and a 2nd L signal (second spool 14 low) from the second section of the control 42 is also fed to the AND gate 92. The 2nd L signal has a high level when the amount of wire on the second spool 14 is at a low level; and, therefore, when both the 2nd L signal and the 1st L signal from the AND gate 88 are at high levels, and AND gate 92 sends a high level Stop signal to an OR gate 94. The OR gate 94 receives a Stop signal from the second section of the control 42; and when this Stop signal or the Stop signal from the AND gate 92 is at a high level, the OR gate 94 emits a high level Stop Line signal for effecting a controlled shutdown of the first drive mechanism 24 and any operatively connected downstream processing equipment. The circuit 80 also receives a Running 1st signal from the first line sensor 40, and this signal is fed to an AND gate 90, along with the 2nd L signal. When both of these signals are at high levels, the AND gate 96 emits a high level Load signal to an OR gate 98, which in turn emits a Load Reel signal to actuate a load reel indicator light 100 when the first spool 12 is empty. The OR gate 98 also receives a corresponding Load signal from the second section of the control 42 for actuating the indicator light 100 when the second spool 14 is empty. The circuit 80 further comprises an OR gate 102 which receives the Running 1st signal from the line sensor 40 and a Start 1st signal (start first cap 20) from the second section of the control 42 and when either of these signals is at a high level, the OR gate 102 emits a Run 1st signal which is fed to the first drive mechanism 24 to operate the first drive mechanism 24 in an energized state.

The second section of the control 42 which is responsive to the diameter sensors 34, the line speed sensor 39 and the line sensor 41 includes a logic circuit which is essentially identical to the circuit 80, although it does not include separate OR gates 94 and 98. However, the corresponding Stop and Load signals from the logic circuit in the second control section are fed to the OR gates 94 and 98 of the logic circuit 80 as illustrated.

Accordingly, during operation of the apparatus 10, the payoff cap 20 is rotated by the drive mechanism 24, and wire 15 is initially payed off from the spool 12. As the wound diameter of the spool 12 is gradually reduced so that the amount of tension applied to the wire 15 by the first cap 20 is increased due to the angle of the wire 15, the control 42 operates to reduce the amount of tension applied to the wire 15 by the brake assembly 38 so that the tension in the wire 15 which is drawn from the apparatus 10 is maintained at a substantially uniform level. Further, as the wound diameter of the spool 12 is gradually reduced so that the relative flip speed of the wire 15 passing over the first cap 20 is increased, the control 42 operates to increase the rotational speed of the first payoff cap 20 so that it is maintained at a substantially uniform level relative to the relative flip speed. Still further the control 42 operates to adjust the rotational speed of the cap 20 to compensate for changes in the line speed. When the amount of wire payed off from the first spool 12 reaches a predetermined low level, the control 42 checks to see if the second spool 14 is either full or empty; and if it is full, the control 42 actuates the second drive mechanism 26 to commence rotation of the second cap 22 before payoff is transferred to the second spool 14. On the other hand, if the second spool 14 is empty, the control 42 deactuates the first drive mechanism 24 and it preferably also shuts down any downstream equipment (not shown) which is operatively connected to the control 42, such as equipment utilized for drawing wire from the apparatus 10. As a result, payoff from the apparatus 10 can be automatically shut down before the supply of wire 15 on the spool 12 is exhausted.

It is seen therefore that the instant invention provides an effective and improved wire payoff apparatus. The control 42 is operative for controlling the drive mechanisms 24 and 26 and the brake assembly 38 so that wire can be effectively payed off from the apparatus 20 with a substantially uniform level of tension. In this connection, because the sensors 32 and 34 are operative for sensing the wound diameters of the spools 12 and 14, respectively, it is not necessary to observe the spools 12 and/or 14 during normal operations; and hence it is possible for the enclosure drums 28 and 30 to include and the end plates 50 for completely enclosing the spools 12 and 14 and for thereby reducing the level of noise emitted from the apparatus 10 as wire is payed off the spools 12 and 14. Accordingly, for these reasons, as well as the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and describe except insofar as indicated by the scope of the appended claims.

What is claimed is:

1. In a wire payoff apparatus of a type including first and second wire spools for containing wire wound thereon in first and second wound directions, respectively, each of said spools having a payoff end, the payoff ends of said first and second spools being in adjacent spaced relation, first and second rotatable payoff caps on the payoff ends of said first and second spools, respectively, first and second adjustable cap rotating means actuatable for rotating said first and second caps, respectively, relative to said first and second spools, respectively, in directions opposite the wound directions of the wire thereon, respectively, wire being alternatively payed off said first spool so that it passes over the payoff cap thereof or said second spool so that it passes over the payoff cap thereof and brake means for alternatively receiving wire from said first spool or said second spool and for applying tension thereto as it is drawn from said apparatus, the improvement comprising first and second diameter sensor means for sensing the wound diameters of said first and second spools, respectively, line sensor means for sensing whether line is being payed off said first spool or said second spool, and control means responsive to said first and second diameter sensor means and said line sensor means for controlling said first and second cap rotating means to increase the rotational speed of the cap from which line is being payed off in a direction opposite the wound direction of the respective spool thereof as the wound diameter of the respective spool thereof is decreased.

2. The payoff apparatus of claim 1, further comprising line speed sensor means for sensing the line speed of wire drawn from said apparatus, control means also being responsive to said line speed sensor means and maintaining the ratio between the rotational speed of the cap of the spool from which wire is being payed off and the flip speed of the wire passing over the cap of the spool form which wire is being payed off at a substantially uniform level.

3. In the payoff apparatus of claim 2, said control means further characterized as maintaining the speed of the cap of the spool from which wire is being payed off at a level which is slightly slower than the flip speed of the wire passing over the cap of the spool from which wire is being payed off.

4. In the payoff apparatus of claim 1, said control means being operative for calculating the amounts of wire on said spools, said apparatus further comprising first and second indicating means responsive to said control means for indicating the amounts of the wire on said first and second spools respectively.

5. In the payoff apparatus of claim 1, said control means being further operative for actuating the cap rotating means of the spool from which wire is not being payed off when the wound diameter of the spool from which wire is being payed off reaches a predetermined level as long as the wound diameter of the spool from which wire is not being payed off exceeds a predetermined level.

6. In the payoff apparatus of claim 1, said control means being further operative for deactuating the cap rotating means of the spool from which wire is being payed off when the wound diameter of the spool from which wire is being payed off reaches a predetermined level in the event that the wound diameter of the spool from which wire is not being payed off is below a predetermined level.

7. In the payoff apparatus of claim 1, said control means being further operative for controlling said brake means for reducing the amount of tension applied by said brake means to a wire drawn from said apparatus as the wound diameter of the spool from which said wire is being payed off is decreased.

8. The payoff apparatus of claim 1 further comprising first and second enclosure drums around said first and second spools, respectively, each of said enclosure drums including a payoff end having an opening therethrough for passing wire outwardly as it is payed off the respective spool thereof, said enclosure drums being adapted to permit automatic transfer of payoff of a continuous wire from said first spool to said second spool upon completion of payoff from said first spool, the ends of said enclosure drums opposite the payoff ends thereof being substantially completely closed.

9. In a wire payoff apparatus of a type including first and second wire spools for containing wire wound thereon in first and second wound directions, respectively, each of said spools having a payoff end, the payoff ends of said first and second spools being in adjacent spaced relation, first and second rotatable payoff caps on the payoff ends of said first and second spools, respectively, first and second adjustable cap rotating means actuatable for rotating said first and second caps, respectively, relative to said first and second spools, respectively, in directions opposite the wound directions of the wire thereon, respectively, wire being alternatively payed off said first spool so that it passes over the payoff cap thereof or said second spool so that it passes over the payoff cap thereof, and adjustable brake means for alternatively receiving wire from said first spool or said second spool and for applying tension thereto as it is drawn from said apparatus, the improvement comprising first and second diameter sensor means for sensing the wound diameters of said first and second spools, respectively, and control means responsive to said first and second diameter sensors means for controlling said brake means for reducing the amount of tension applied by said brake means to a wire drawn from said apparatus as the wound diameter of the spool from which said wire is being payed off is decreased.

10. In a wire payoff apparatus of a type including a wire spool for containing wire wound thereon in a wound direction, said spool having a payoff end, a rotatable payoff cap on the payoff end of said spool, adjustable cap rotating means for rotating said cap relative to said spool in a direction opposite the wound direction of the wire thereon, wire being payed off said spool so that it passes over the payoff cap thereof, and brake means for receiving wire from said spool and for applying tension thereto as it is drawn from said apparatus, the improvement comprising diameter sensor means for sensing the wound diameter of said spool and control means responsive to said diameter sensor means for controlling said cap rotating means to increase the rotational speed of the cap thereof in a direction opposite the wound direction of said spool as said wound diameter is decreased.

11. The wire payoff apparatus of claim 10 further comprising line speed sensor means for sensing the line speed of wire drawn from said apparatus, said control means further characterized as maintaining the ratio between the rotational speed of said cap and the flip speed of the wire passing over said cap at a substantially uniform level.

12. In the apparatus of claim 10, said control means being operative for calculating the amount of wire on said spool, said apparatus further comprising indicating means responsive to said control means for indicating the amount of wire on said spool.

13. In the apparatus of claim 10, said control means being further operative for controlling said brake means for reducing the amount of tension applied by said brake means to a wire drawn from said apparatus as the wound diameter of said spool is decreased.

14. The apparatus of claim 10 further comprising an enclosure drum around said spool, said enclosure drum including a payoff end having an opening therethrough for passing wire outwardly as it is payed off said spool, the end of said enclosure drum opposite the payoff end thereof being substantially completely closed.

15. In a wire payoff apparatus of a type including a wire spool for containing wire wound thereof in a wound direction, said spool having a payoff end, a rotatable payoff cap on the payoff end of said spool, cap rotating means for rotating said cap relative to said spool in a direction opposite the wound direction thereof, wire being payed off said spool so that it passes over said payoff cap, and brake means for receiving wire from said spool and for applying tension thereto as it is drawn from said apparatus, the improvement comprising diameter sensor means for sensing the wound diameter of said spool and control means responsive to said diameter sensor means for controlling said brake means for reducing the amount of tension applied by said brake means to a wire drawn from said apparatus as the wound diameter of said spool is decreased.

16. In the wire payoff apparatus of claim 15, said control means further characterized as controlling said brake means for reducing the amount of tension applied by said brake means to a wire drawn from said apparatus in proportion to the wound diameter of said spool.

17. The apparatus of claim 15, further comprising an enclosure drum around said spool, said enclosure drum including a payoff end having an opening therethrough for passing wire outwardly as it is payed off said spool, the end of said enclosure drum opposite the payoff end thereof being substantially completely closed.

* * * * *